United States Patent [19]

Kulesza et al.

[11] 4,425,735

[45] Jan. 17, 1984

[54] TOY VEHICLE DEVICE

[75] Inventors: Ralph J. Kulesza, Chicago; Harry Disko, South Barrington, both of Ill.

[73] Assignee: Marvin Glass & Associates, Chicago, Ill.

[21] Appl. No.: 400,346

[22] Filed: Jul. 21, 1982

[51] Int. Cl.[3] ..... A63H 11/10

[52] U.S. Cl. ..... 46/202; 46/1 K

[58] Field of Search ..... 46/202, 201, 251, 206, 46/1 K

[56] References Cited

U.S. PATENT DOCUMENTS

| | | | |
|---|---|---|---|
| 2,788,613 | 4/1957 | Gelfand et al. | 46/202 |
| 3,616,571 | 11/1971 | Adickes | 46/202 |
| 4,146,991 | 4/1979 | Sand | 46/202 |

*Primary Examiner*—Mickey Yu

[57] ABSTRACT

A toy vehicle device includes a toy vehicle and a vehicle track in the form of a belt having a buckle that releasably retains the vehicle on an outwardly facing surface thereof. The buckle further includes a propulsion mechanism for propelling the vehicle from the buckle along the length of an upwardly facing surface of the belt. Thus, the belt may normally be worn around the waist of the user, with the vehicle secured to the buckle, so that the belt functions in a conventional manner to support the user's pants. When it is desired to use the belt as a toy, a belt end is detached from the buckle, the belt is removed from the user's waist, and the vehicle is actuated to move along the belt. The buckle further includes additional retainers for retaining the belt in various configurations to enhance the use of the belt as a track for the vehicle.

16 Claims, 12 Drawing Figures

TOY VEHICLE DEVICE

BACKGROUND OF THE INVENTION

1. Field of the Invention

This invention relates generally to toy vehicle sets and particularly to a body wearable toy vehicle device.

2. Brief Description of the Background Art

The desirability of securing a play toy to the human body for convenient transport and play enhancement has been recognized in the past. A toy vehicle, marketed under the name WRIST RACERS, by the Knickerbocker Toy Company, Inc., is supportable on a platform secured to the wrist by a wrist watch-type strap. The vehicle is propelled from a platform onto a surface along an outwardly extending ramp. A toy vehicle device securable to the user's fingers is described in copending U.S. patent application Ser. No. 343,879 by Kulesza, et al., assigned to the assignee of the present invention. While these devices are capable of providing unique action and considerable enjoyment, there is a continued demand for new and entertaining devices of this type.

SUMMARY OF THE INVENTION

It is a primary object of the present invention to provide a belt which is capable of functioning as a toy vehicle and track.

This and other objects of the present invention are provided by a toy vehicle device wearable about the user's waist. The device includes an elongate belt with a pair of end portions. A buckle is securable to one end portion of the belt and includes means for releasably securing the buckle to the other end portion of the belt to secure to belt about the user's waist. A toy wheeled vehicle, releasably securable to the buckle, is sized for movement along the length of the belt.

DESCRIPTION OF THE PREFERRED EMBODIMENT

Figure 1:
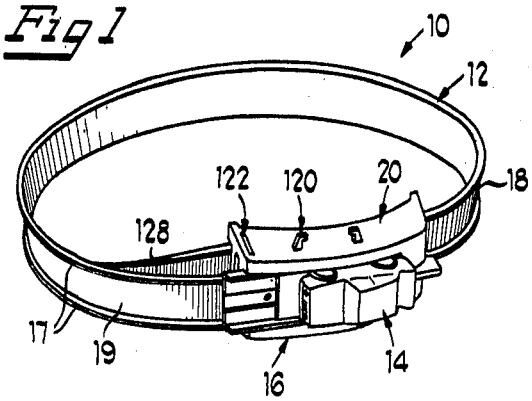
FIG. 1 is a perspective view of one embodiment of the present invention in a configuration in which it may be worn by a user.

Referring to the drawing wherein like reference characters are used for like parts throughout the several views, a toy vehicle device 10, shown in FIG. 1, includes a belt 12 and a toy wheeled vehicle 14 releasably securable to the belt 12. The belt 12 includes a vehicle supporting buckle 16 and an elongate vehicle track 18.

The track 18, advantageously made of flexible material such as plastic, includes a pair of upwardly extending rails 17 on the edges of its track surface 19. As may be discerned from FIGS. 1 and 2, the toy vehicle device 10 may be arranged in a configuration to be worn by the user in the manner of a belt or may be removed from the user and arranged to function as a toy vehicle and vehicle track.

Figure 5:
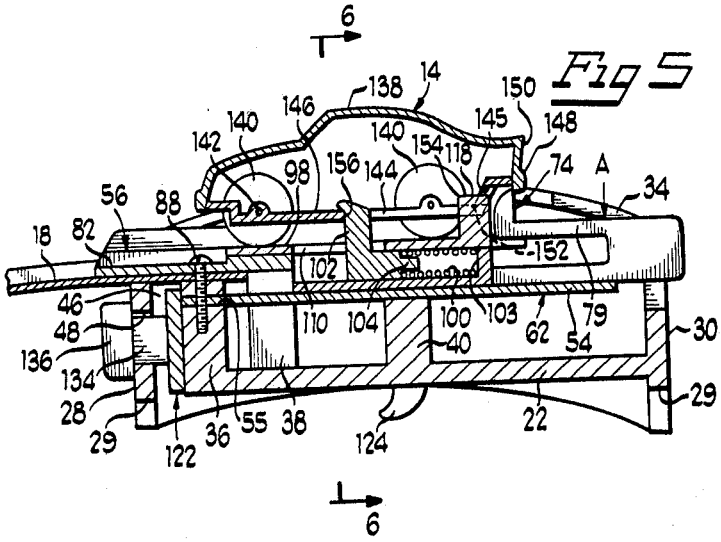
FIG. 5 is a partial, enlarged, cross-sectional view taken generally along the line 5—5 in FIG. 2.
Figure 6:
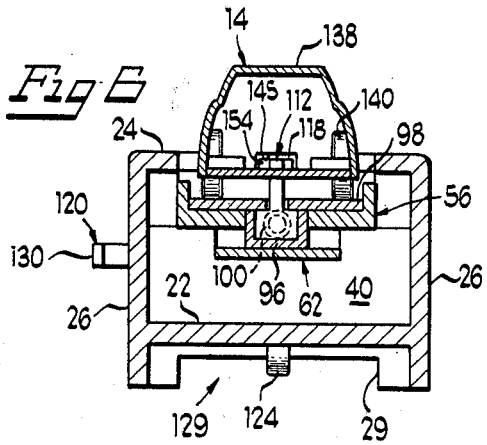
FIG. 6 is a cross-sectional view taken generally along the line 6—6 in FIG. 5.
Figure 7:
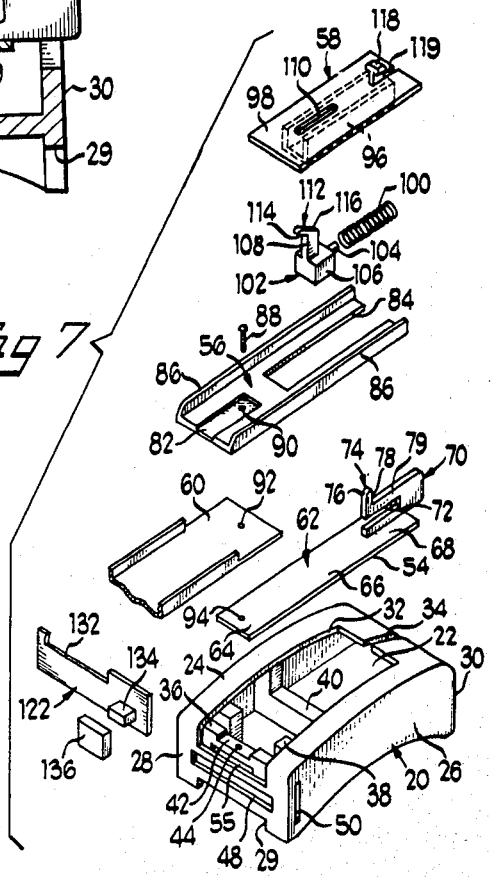
FIG. 7 is an enlarged, exploded view of the buckle shown in FIG. 1.

As shown in FIG. 7, the buckle 16 includes a housing 20, generally in the shape of an annular segment, in order to conform to the curvature of the human waist. The housing 20 includes a lower surface 22, an outwardly facing surface 24, a pair of opposed side surfaces 26, a front end surface 28, and a rear end surface 30. A portion of the housing 20 adjacent the rear end surface 30 is larger than that adjacent the front end surface 28 so that the housing 20 inclines upwardly as it extends from the front end surface 28 to the rear end surface 30, when supported on a supporting surface, as shown in FIG. 5. The front end surface 28 and rear end surface 30 each include a notch 29, near their point of intersection with the lower surface 22. The outwardly facing surface 24 includes an opening 32 which communicates with a rearwardly extending slot 34.

Within the interior of the housing 20, a set of three U-shaped crosspieces 36, 38 and 40 are arranged with their openings facing upwardly toward the surface 24. The crosspiece 36, located closest to the front end surface 28, includes only a slight depression 42 in its upper surface punctuated by a threaded aperture 44. The crosspiece 36 defines a lateral channel 46 between itself and the front end surface 28. The channel 46 communicates with the exterior of the housing 20 by way of the opening 32 as well as by a forwardly facing slot 48 in the front end surface 28 and a laterally facing slot 50 in each side surface 26. Each of the crosspieces 36, 38 and 40, in addition to being attached to each side surface 26, is also attached to the lower surface 22 of the housing 20.

The crosspieces 36, 38, and 40 support a spring catch 54, a slotted plate 56, and a body 58. In addition, the crosspiece 36 supports an end 60 of the vehicle track 18. While the spring catch 54 rests directly on the crosspiece 40 and within the slot 55 in the crosspiece 36, the belt end 60 is located on the crosspiece 36 within the depression 42 and beneath the slotted plate 56. The body 58 rests in part atop the slotted plate 56, in part on the spring catch 54 and in part on the crosspiece 38.

The spring catch 54 includes a leaf spring element 62 connectable at its forward end 64 to the crosspiece 36. The intermediate portion 66 of the element 62 is supported atop the crosspiece 40 while the free end portion 68 extends unsupported over the lower surface 22. An upwardly facing surface of the free end portion 68 includes a U-shaped catch 70 with a slot 72 that extends inwardly from the forwardly facing edge of the catch 70. A tab 74 protrudes upwardly from the upper cantilevered horizontal portion 79 of the catch 70, the tab including a curved forward edge 76 and a vertical rearward edge 78. The upper cantilevered horizontal portion 79 of the catch 70 passes through the slot 34 in the housing 20.

The slotted plate 56 includes a recessed portion 82, an inwardly directed slot 84 and a pair of lateral, upstanding rails 86. An aperture 90, formed in the recessed portion 82, receives a fastener 88 which also extends through an aperture 92 in the belt end 60, and through both the aperture 94 in the forward end 64 of the leaf spring element 62 and the aperture 44 in the crosspiece 36. Thus, the fastener 88, conveniently a screw, secures the slotted plate 56, the leaf spring element 62, and the track 18 to the crosspiece 36.

Figure 4:
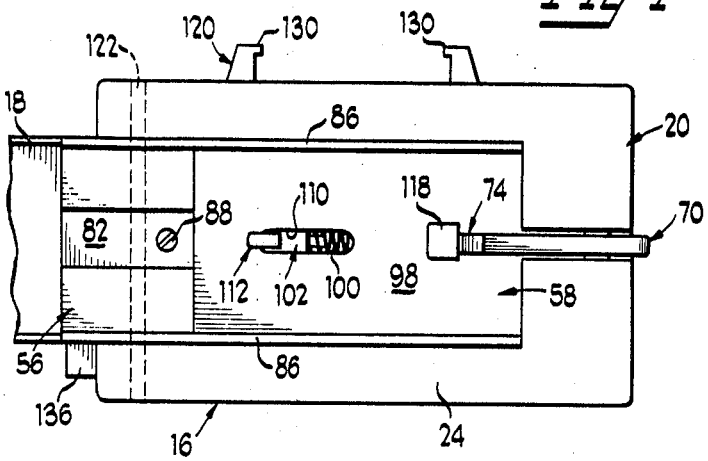
FIG. 4 is an enlarged, partial, plan view of the buckle shown in the FIG. 1 without the toy vehicle.

The body 58 includes a casing 96 and an upper plate 98. The casing 96 fits into and through the slot 84 in the plate 56 while the upper plate 98 rests atop the slotted plate 56. The casing 96 includes a coil spring 100 and a vehicle retaining catch 102. The spring 100 engages a rearwardly directed pin 104 on the catch 102 and normally biases the catch 102 forwardly due to the sandwiching of the spring 100 between the catch 102 and a vertical wall 103 of the casing 96. The catch 102 includes a widened lower end 106 arranged to slide within the interior of the casing 96 along a fore to aft line. A catch portion 108 juts upwardly over the buckle from the widened lower end 106, through a slot 110 in the upper plate 98. The catch portion 108 includes an extension 112 which defines a catch region 114 on the forward face of the catch portion 102 and an inclined, cam region 116 on the upper and rearward face of the catch portion 108. A T-shaped guide pin 118 extends upwardly from the upper plate 98 at a position rearward of the slot 110 just ahead of an inwardly directed slot 119. The contilevered horizontal portion 79 of the catch 70 is arranged over the slot 119, as shown in FIG. 4.

Figure 3A:
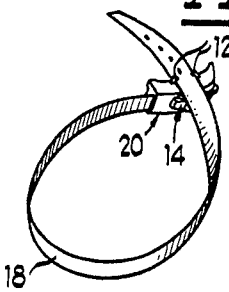
FIGS. 3*a* and 3*b* are reduced perspective views of still additional configurations for use of the embodiment shown in FIG. 1 as a toy vehicle device.
Figure 3C:
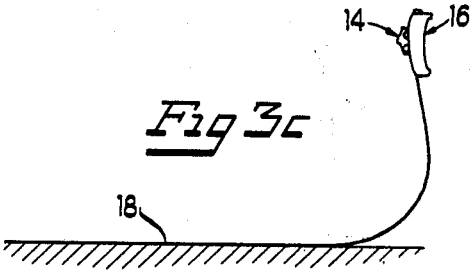
FIGS. 3*c* through 3*f* are reduced, side elevational views of still additional configurations which may be assumed by the embodiment shown in FIG. 1.
Figure 3B:
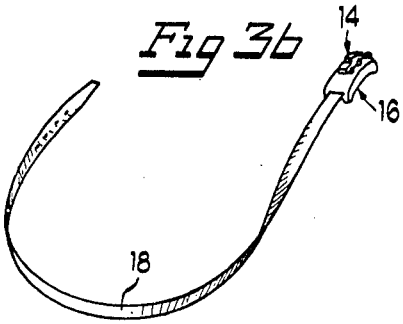
Figure 3D:
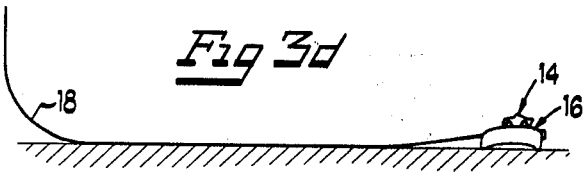
Figure 3E:
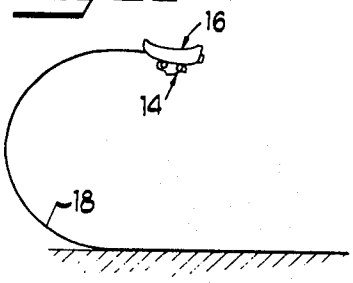
Figure 3F:
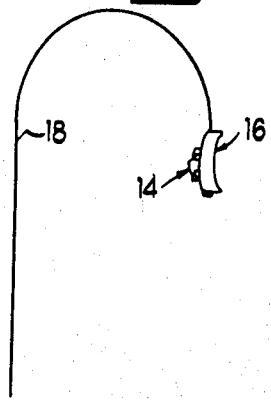

The housing 20 also includes a series of belt retaining projections including the lateral hooks 120, the sliding belt latch 122, and the belt end portion hook 124. The belt end portion hook 124, positioned on the lower surface 22 of the housing 20, is arranged to engage the apertures 126 in the belt free end portion 128 which fits within the channel 129, defined by the notches 29, beneath the lower surface 22. The apertures 126 are arranged generally in a line so that the circumference of the loop formed by the track 18 may be adjusted by positioning the correct aperture 126 over the belt end portion hook 124. The lateral belt hooks 120 extend outwardly of a side surface 26 of the housing 20 and are spaced sufficiently to retain a region of the track 18 between them in a transverse configuration with regard to the length of the buckle 16. The hooks 120 include catches 130 which extend inwardly to retain the belt region between the hooks 120 and the housing 20, as indicated in FIG. 3*a*.

Figure 2:
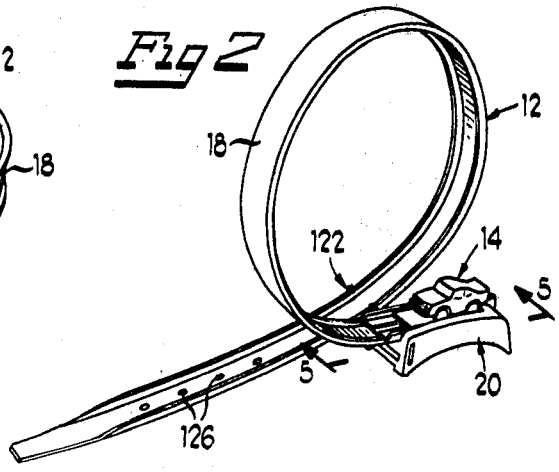
FIG. 2 is a perspective view of the embodiment shown in FIG. 1, in a configuration for use as a toy vehicle device.

The sliding belt latch 122 is situated to slidingly reciprocate in and out of the lateral channel 46 in the housing 20. The latch 122 includes an upwardly facing U-shaped notch 132, a forwardly extending pin 134, and a retainer handle 136. The latch 122 slides within the channel 46 with the pin 134 sliding along the forwardly facing slot 48. The latch 122 is secured within the channel 46 by the retainer handle 136 which is secured on the outside of the housing 20 to the end of the pin 134. The latch 122 is extendable out of the housing 20 by way of a laterally facing slot 50. Thus, the latch 122 may extend from the position, shown in FIG. 1, located wholly within the housing 20 to the position extending outwardly thereof, as shown in FIG. 2. Then the latch 122 may be secured to a portion of the track 18 by fitting the track 18 into the notch 132 so that the retained track portion is arranged generally parallel to the length of the buckle 16.

The toy wheeled vehicle 14 includes a housing 138 and two pairs of wheels 140, each pair of wheels 140 connected by an axle 142 rotatably retained in the housing 138. A slot 144, directed inwardly from an opening 145 on the rear end of vehicle, is defined in the lower surface 146 of the housing 138. In addition, a prong 148 depends downwardly from the rear surface 150 of the vehicle 14. As shown in FIG. 5, the slot 144 is arranged to receive the vehicle retaining catch 102 within the interior of the housing 138 and to slidingly engage the T-shaped guide pin 118. More specifically, the slot 144 receives the base 152 of the pin 118 while the widened cap 154 of the pin 118, having entered through the opening 145, slides on top of the housing lower surface 146. Thus, the vehicle 14 may be slid onto the buckle 16 allowing the catch 102 to move inwardly until it reaches the forward edge 156 of the slot 144. Shortly after receiving the catch 102, the housing 138 is engaged by the pin 118 and is prevented from moving outwardly away from the buckle 16 by this engagement. Forward movement of the vehicle 14 is prevented by the engagement of the tab 74 and particularly its rearward edge 78, with the prong 148, as shown in FIG. 5.

The device 10 may be used generally in the following manner. Initially the vehicle 14 is secured on the buckle 16 by moving the vehicle 14 in a rearward direction into engagement with the catches 70 and 102. This may be accomplished by rolling the vehicle 14 rearwardly over the buckle 16, and particularly over the slotted plate 56 and upper plate 98. During this motion, the catch 102 slides along the slot 144 until the catch region 114 is in abutment with the forward edge 156. The T-shaped guide pin 118 enters the opening 145, slides along the slot 144 and is engaged therein, preventing the vehicle 16 from moving outwardly away from the outwardly facing surface 24 of the housing 20. Eventually the prong 148 engages the tab 74 of the catch 70 and deflects it downwardly. The downward deflection of the tab 74 is made possible by the inherent resiliency of the catch 70 and the free end portion 68 of the leaf spring element 62. In addition, the curved forward edge 76 facilitates the downward camming actuation of the tab 74 until the prong 148 moves rearwardly past the tab 74 at which time the tab 74 springs upwardly and the vertical rearward edge 78 is located in abutment with the prong 148. In this position, the vehicle 14 is releasably fixed atop the buckle 16.

The location of the catch 102, when the spring 100 is unbiased, with respect to the position of the prong 148 and tab 74 is such that the catch 102 must move in a rearward direction to enable the vehicle 14 to be retained by the tab 74 of the catch 70. Thus, the catch 102, engaged by the edge 156, moves in a rearward direction biasing the coil spring 100 until the tab 74 engages the prong 148. Therefore, when the tab 74 is depressed by a force which may be manually applied to the cantilevered horizontal portion 79, in the direcion of the arrow "A" in FIG. 5, the vehicle 14 springs forwardly due to the energy stored in the spring 100 as soon as the tab 74 is free of the prong 148. As the vehicle 14 is propelled forwardly, it rolls off of the buckle 16 onto the track 18. The rails 17 guide the movement of the vehicle 14 along the track surface 19 of the track 18.

The configuration of the belt 12 is amenable to the application of considerable user ingenuity in providing an interesting path of movement for the vehicle 14, as indicated in FIGS. 2 and 3. The spiral configuration of the belt 12 shown in FIG. 2 is made possible by the latch 122. By sliding the retainer handle 136 along the slot 48, the latch 122 is pushed outwardly of the housing 20. A portion of the track 18 may then be secured within the notch 132 to form the spiral configuration illustrated. The centrifugal force inherent in the high speed of vehicle 14 movement maintains the vehicle 14 on the track 18 despite the effect of gravity. In FIG. 3*a* a convoluted track 18 configuration is made possible by looping the belt end 128 over the buckle 16 and securing it thereto through the operation of the lateral belt hooks 120. A great variety of twisted and turned configurations of the track 18, such as those shown in FIGS. 3*b*–3*e*, may be achieved by appropriately bending the flexible track 18 to conform to various obstructions, or, as shown in FIG. 3*f*, by utilizing the somewhat slight rigidity of the track 18 to form a hoop. As best shown in FIG. 3*d*, the configuration of the housing 20 provides an incline which encourages the vehicle 14 to move downwardly onto the track 18.

After play is complete, the vehicle 14 may be secured on the buckle 16 in the manner described previously and the belt 12 may be returned to a position supporting the user's pants in a well known fashion. Specifically, the belt 12 may be threaded through the loops of the user's pants (not shown) and the buckle 16 secured to the belt free end 128 through the engagement of the belt end portion hook 124 with the appropriate aperture 126.

In this way, the toy vehicle device 10 serves not only as a belt, but also as an amusing toy. The combination provides unique interaction and particularly this configuration enables the toy vehicle device 10 to be conveniently carried by the user. The arrangement of the various parts, therefore, serves not only a functional and play toy purpose, but serves to create a novelty item as well. In this way, the present invention provides an arrangement which is capable of considerable value to the user.

While the present invention has been described with respect to a preferred embodiment, it will be apparent that various changes and modifications will occur to those skilled in the art. It is intended within the appended claims to cover all such changes and modifications as fall within the true spirit and scope of the present invention.

What is claimed and desired to be secured by Letters Patent of the United States is:

1. A toy vehicle device wearable about a user's waist, said device comprising:

an elongate belt including a pair of end portions;

a buckle securable to one end portion of said belt and including means for releasably securing said buckle to the other end portion of said belt to secure said belt around the user's waist;

a toy wheeled vehicle sized for movement along the length of said belt; and means on said buckle for releasably securing said vehicle to said buckle.

2. The device of claim 1 wherein said buckle includes manually actuable propulsion means, mounted on said buckle, for propelling said vehicle from said buckle along said belt.

3. The device of claim 2 wherein said propulsion means includes a spring biased actuator, said actuator being automatically biased upon positioning of said vehicle on said buckle.

4. The device of claim 3 wherein said vehicle is arranged to slidingly engage said buckle.

5. The device of claim 4 wherein said vehicle securing means includes means for automatically securing said vehicle to said buckle upon rolling movement of said vehicle over said buckle.

6. The device of claim 5 wherein said buckle includes a manually actuable catch arranged to engage said vehicle when said actuator is sufficiently biased.

7. The device of claim 1 wherein said buckle includes means for releasably engaging said belt at a position spaced from an end thereof and arranging said belt in a twisted configuration.

8. The device of claim 7 wherein said engaging means includes a pair of prongs extending outwardly from said buckle.

9. The device of claim 7 wherein said engaging means includes a latch slidable from a position located within said buckle to a position extending outwardly of said buckle.

10. The device of claim 9 wherein said latch includes a notch arranged to frictionally engage said belt.

11. The device of claim 10 wherein said latch includes a slidable handle extending outwardly of said buckle.

12. The device of claim 7 wherein said engaging means is arranged to secure a portion of said belt generally parallel to the length of said buckle.

13. The device of claim 7 wherein said engaging means is arranged to secure a portion of said belt generally perpendicular to the length of said buckle.

14. The device of claim 1 wherein said belt includes a pair of parallel lateral rails extending generally along the length of said belt to retain said vehicle on said belt as said vehicle moves over said belt.

15. The device of claim 1 wherein said belt includes a plurality of apertures near one end thereof, and said buckle includes a hook arranged to engage at least one of said apertures in order to secure said belt in a loop about the user.

16. The device of claim 1 wherein said belt is made of flexible material.

* * * * *